US006521682B1

(12) United States Patent
Costantino et al.

(10) Patent No.: US 6,521,682 B1
(45) Date of Patent: Feb. 18, 2003

(54) TEXTILE MATERIALS WITH FIREPROOF ADDITIVE AND METHOD FOR PRODUCING

(75) Inventors: Rocco Costantino, Rome (IT); Ennio Giuliacci, Terni (IT); Elisabetta Baroni, Prato (IT); Mario Bartolini, Montale Pistoia (IT); Paolo Bartolini, Montale Pistoia (IT); Massimiliano Castagnoli, Prato (IT); Mario Cocci, Calenzano Firenze (IT)

(73) Assignee: Alcantara S.p.A., Milan (IT)

( * ) Notice: Subject to any disclaimer, the term of this patent is extended or adjusted under 35 U.S.C. 154(b) by 0 days.

(21) Appl. No.: 09/616,138

(22) Filed: Jul. 13, 2000

(30) Foreign Application Priority Data

Jul. 13, 1999 (IT) ..... MI99A1539

(51) Int. Cl.[7] ..... C08K 5/3492; C08K 9/12; C08K 9/04

(52) U.S. Cl. ..... 524/101; 523/205; 523/206; 523/207; 523/210; 524/100; 524/720; 524/802; 162/12; 162/72; 162/159; 162/168.1; 442/147; 442/154; 442/281; 428/921; 525/329.9

(58) Field of Search ..... 252/608, 609, 252/610; 442/147, 154, 281; 524/101, 100, 720, 802; 162/12, 72, 159, 168.1; 428/921; 525/329.9; 523/205, 208, 207, 210

(56) References Cited

U.S. PATENT DOCUMENTS

| | | | | | |
|---|---|---|---|---|---|
| 3,017,280 | A | * | 1/1962 | Yudelson | 106/125 |
| 3,093,602 | A | * | 6/1963 | Booth et al. | 260/17 |
| 3,261,796 | A | * | 7/1966 | Simms | 260/29.6 |
| 3,531,368 | A | | 9/1970 | Okamoto et al. | |
| 3,540,892 | A | * | 11/1970 | Lard et al. | 106/15 |
| 3,753,941 | A | * | 8/1973 | Teumac et al. | 260/29.7 |
| 3,912,581 | A | * | 10/1975 | Fink et al. | 162/164 |
| 3,944,688 | A | * | 3/1976 | Inman | 427/381 |
| 4,009,310 | A | * | 2/1977 | Scobbo | 428/97 |
| 4,180,496 | A | * | 12/1979 | Yanagimoto et al. | 260/45.7 |
| 4,224,169 | A | * | 9/1980 | Retana | 252/8.1 |
| 4,247,332 | A | * | 1/1981 | Kinoshita et al. | 252/8.1 |
| 4,317,766 | A | * | 3/1982 | Kawasaki et al. | 524/101 |
| 4,321,189 | A | * | 3/1982 | Ohshita et al. | 524/101 |
| 4,702,861 | A | * | 10/1987 | Farnum | 521/906 |
| 5,169,888 | A | * | 12/1992 | Sales | 524/507 |

FOREIGN PATENT DOCUMENTS

| | | |
|---|---|---|
| EP | 718 388 | 6/1996 |
| GB | 1 480 556 | 7/1977 |
| IT | 823 055 | 9/1968 |
| IT | 839 921 | 3/1969 |
| IT | 858 373 | 2/1970 |
| IT | 873 699 | 10/1970 |
| IT | 905 222 | 2/1972 |
| IT | 921 871 | 6/1972 |
| IT | 1291999 | 5/1997 |
| IT | 1302041 | 9/1998 |
| WO | 98/27164 | 6/1998 |

OTHER PUBLICATIONS

Petrolite Corp. V. Watson, Comr. Ports (DC DC) 113 USPQ 248, 1957.*

Austenal Laboratories, Incorporated V. Nobilium Processing Company of Chicago et al. (DC NILL) 115 USPQ 44, 1957.*

Handbook of Chemistry & Physics—40th edition—pp. 1086–1087 Chemical Rubbs Publishing Co., Cleveland Ohio (1959).*

* cited by examiner

*Primary Examiner*—Peter Szekely
(74) *Attorney, Agent, or Firm*—Pauley Petersen Kinne & Erickson

(57) ABSTRACT

A flame-resistant additive for textile materials and microfiber non-woven fabrics of the artificial-leather type that imparts a high level of fireproofing properties to the textile material treated without negatively affecting the visual and mechanical characteristics, softness to the touch. The flame-resistant additive includes a fireproofing component having a finely divided mixture of melamine and melamine cyanurate and a clay or other adsorbent material such as diatomaceous earth, zeolite, inorganic oxides such as alumina, silica, magnesium oxide or mixtures of inorganic oxides and a binder which includes an aqueous dispersion of an acrylic or maleic polymer or copolymer and a multifunctional cross-linker of the acrylic or maleic polymer or copolymer.

20 Claims, No Drawings

TEXTILE MATERIALS WITH FIREPROOF ADDITIVE AND METHOD FOR PRODUCING

BACKGROUND OF THE INVENTION

1. Field of the Invention

This invention relates to a flame-resistant agent for the treatment of non-woven fabrics, a procedure for its preparation and the non-woven fabrics made fireproof as a result of treatment with the flame-resistant agent.

2. Description of Prior Art

Microfiber non-woven fabrics are known in the art, for instance, the type produced by ALCANTARA S.p.A. Products of this type are also described in Italian patents 823,055; 839,921; 858,373; 873,699; 905,222; 921,871 and in U.S. Pat. Nos. 3,531,368 and 3,899,623.

For numerous final applications, for instance furnishing, and in some markets for almost all uses, the microfiber fabrics must conform to precise flame resistance requirements.

There are essentially three procedures known for endowing microfiber fabrics with the required flame-resistant characteristics. According to a first procedure, known as padding, the fabric is subjected to impregnation in a bath containing flame-resistant additives and subsequently dried. This process has the disadvantage of giving a "buffed suede" finish that has worse hand and softness characteristics than the original non-flame-resistant product. Furthermore, this treatment is not permanent.

A second method known as "back side" coating provides for the application of a paste containing flame-retarding compounds (such as halogens, antimony and phosphorus) to the "back" side of the synthetic non-woven fabric. This method does not have the disadvantage of padding in as much as the "front" side of the fabric is not affected by the treatment, but given the large quantity of flame-retarding compounds required to confer the desired effect, the treated product presents a "harder" hand and is therefore less drapable than the non-treated product.

A third method is to form a non-woven fabric compound of intrinsically flame-retardant microfiber polymer (e.g. PET) and a polyurethane solution, which alone or with antimony oxide and deca-bromo-diphenyl oxide additives, impregnates the substrate. Although guaranteeing flame resistance, the combined use of intrinsically fireproof microfiber polymers and additives (in varying proportion to the polyurethane) reflects negatively on the visual appearance (short nap, specking), the drapery (hard hand), and the dyeing characteristics (tone), even though the physical-mechanical performance remains within the required range.

Accordingly, there is a need for a flame-resistant additive for microfiber non-woven fabrics of the synthetic leather type that effectively makes such materials fireproof, without negatively affecting either the physical-mechanical characteristics or the aesthetic, hand or dyeing properties of the treated product.

In Italian Patent Application M197A001228, a microfiber non-woven fabric having a flame-retardant additive is described comprising a plurality of microfibers of a polymer material impregnated with a polyurethane matrix, containing trioxide of antimony and deca-bromo-diphenyl oxide, that achieves its fireproof activity by means of application on the "back" side of the fabric in such quantity and in such form as not to negatively influence the visual and hand characteristics of the treated material. This reference discloses a flame-resistant agent comprising antimony trioxide and deca-bromo-diphenyl oxide in a highly dispersed form and supported on a clay or other adsorbent material such as diatomaceous earth, zeolite, inorganic oxides such as alumina, silica, magnesium oxide or compounds of inorganic oxides. These additives and the products treated with said additives have entered commercial use and satisfy all the specific fireproof properties while maintaining the mechanical and aesthetic properties.

However, there is a tendency towards ever stricter regulations that could lead in the future to the imposition of severe limitations on the use of halogen compounds as components of fireproofing agents. The use of antimony derivatives could also be legally restricted in the future, with negative consequences for its wide use as a component of flame-resistant agents.

A possible alternative to the use of compounds containing bromine and antimony could be the use of phosphorus derivatives for the purpose of identifying compounds able to provide fireproof properties to materials impregnated with said compounds.

However, despite some phosphorus derivatives being known which show fireproof activity, compounds that simultaneously answer all the requirements established above, when applied to products of the artificial-leather type based substantially on microfiber non-woven fabrics are still not known.

Trials carried out on a large number of compounds containing phosphorus derivatives to determine their suitability as fireproofing agents for materials of the artificial-leather type constituted substantially of microfiber non-woven fabrics have shown that such additive products, while having good fireproofing characteristics, have evident aesthetic deficiencies. Another problem posed by the use of phosphorus derivatives as flame-resistant agents is that of identifying a binder that, on one hand, allows homogeneous distribution of the additive and yet prevents its separation from the treated product. The separation of the additive from the material treated is commonly called "powdering." As far as properties related to the visual appearance of the product are concerned, it has been found that the application of these flame-resistant compounds imparted a damp or even wet appearance to the product.

Italian Patent Application M198A00192 discloses the use of a flame-resistant additive for non-woven fabrics consisting of a water-soluble compound of cyclical organic phosphonate complexes having a phosphorus content between 15% and 20%, and a water-soluble organic polymer. Such additive, while conferring excellent fireproofing characteristics on the products treated that remain even after repeated dry cleaning, showed the formation of stains on the fabric when the fabric was brought into contact with water.

Therefore the problem of making textile materials, in particular microfiber non-woven fabrics, fireproof in an effective and stable way without influencing the characteristics of the product substantially or negatively, has still not been completely resolved.

SUMMARY OF THE INVENTION

Therefore, it is one object of this invention to provide a flame-resistant additive for microfiber non-woven fabrics of the artificial-leather type that do not contain halogen compounds or other potentially harmful products and that impart good fireproof properties to the non-woven fabric without negatively affecting mechanical characteristics or softness to the touch and without modifying the external appearance even following repeated washings.

It is another object of this invention to provide a procedure for making microfiber non-woven fabric of the artificial-leather type fireproof using such a flame-resistant additive.

It is yet another object of this invention to provide a procedure for preparation of said flame-resistant agent.

It is yet another object of this invention to provide microfiber non-woven fabrics made fireproof by the aforementioned treatment.

These and other objects of this invention are addressed by a fireproofing additive for textile products and particularly for microfiber non-woven fabrics of the artificial-leather type comprising:

a) a fireproofing component comprising a finely divided compound of melamine and melamine cyanurate and a clay or other adsorbent material such as diatomaceous earth, zeolite, inorganic oxides such as alumina, silica, magnesium oxide or compounds of inorganic oxides and b) a binder comprising an aqueous dispersion of an acrylic or maleic polymer or copolymer and a multi-functional cross-linker of the acrylic or maleic polymer or copolymer.

DESCRIPTION OF PREFERRED EMBODIMENTS

It is known that melamine and its derivatives constitute a class of materials which impart flame-resistant characteristics to polymer materials. However, these fireproof characteristics are generally conferred by modifying the polymer, i.e. the melamine or the melamine derivative are mixed intimately with the polymer prior to molding of the same in such a way as to obtain, after working (extrusion, molding, pressure die-casting), a product with intrinsic flame-resistant characteristics. As has been said at the outset, this polymer fireproofing procedure in which the polymer is directly linked to the fireproofing functional group or molecule results in a product that, when made up into textile materials, has characteristics clearly inferior to those of the original untreated polymer. This variation of properties of the formed polymer is particularly important in the case of delicate textile products like, for instance, microfiber non-woven fabrics of the artificial-leather type.

On the other hand, simple impregnation of the finished textile material to be fireproofed with fireproofing additive doesn't guarantee the maintenance of the properties of the material after repeated dry cleaning or washing with water, because the fireproofing agent is progressively removed from the surface of the textile material.

With the additive according to this invention, the fireproofing agent constituted by the melamine and melamine cyanurate mixture is not removed, even when subjected to repeated washings in severe conditions, because it is entrapped in the acrylic or maleic copolymer as a result of crosslinking caused by the multifunctional cross-linker of the binder.

The fireproofing component in accordance with one embodiment of this invention comprises a suspension of particles having an average size less than about 1 $\mu$, preferably in the range of about 1 to 5 $\mu$, which suspension comprises from about 0.05% to about 5% by weight of a clay or other adsorbent material selected from the group consisting of diatomaceous earth, zeolite, inorganic oxides such as alumina, silica, magnesium oxide and a mixture of inorganic oxides. The fireproofing component of the present invention is produced by mixing the components already reduced to the desired granule size, or the desired granule sizes may be obtained by grinding the mixture of the ingredients.

The additive may be applied to the textile material, particularly to a non-woven fabric, by coating with a knife spreader. However, particularly advantageous results have been obtained using a coating treatment referred to as "transfer roller" coating which comprises releasing an amount of application additive carried over from a roller from the lower part toward the top onto the "back" face of the material, as described in Italian Patent Application M197A001228.

The fireproofing component in accordance with one embodiment of this invention further comprises other products that impart other desired characteristics or that favor the formation and the stabilization of the suspension and the application to the textile material such as surfactants, dispersants, wetting agents, pH buffers, anti-fermenting agents and similar agents.

The melamine or melamine cyanurate content in the fireproofing component of this invention comprises in the range of about 30% to about 90% of the total, while the ratio by weight of melamine to melamine cyanurate is in the range of about 0.01:1 to about 0.5:1.

The binder comprises an acrylic copolymer or polymer having free carboxyl or ester groups, preferably polymers or copolymers of acrylic or methacrylic acid or its esters or salts, or of the maleic anhydride polymers or copolymers. Particularly good results have been obtained with the copolymer of acrylic acid or its derivatives and styrene.

The binder further comprises a cross-linking agent that has a critical function for the achievement of the invention. The cross-linking agent must react with the acrylic polymers and copolymers of the binder to provide a three-dimensional structure inside of which is held the fireproofing component. The cross-linking agent must also cause the formation of some forms of bond between the three-dimensional structure and the surface of the textile material being fireproofed. Furthermore, the cross-linking should of necessity occur quickly and at temperatures compatible with the stability of the textile material being treated.

Multifunctional derivatives of aziridine have shown themselves to be particularly useful cross-linking agents which satisfy these requirements. Multifunctional derivatives of aziridine refers to compounds that beyond the imine group of aziridine have other imine or amine groups that can react with the carboxyl groups of the acrylic polymers or copolymers or of the maleic anhydride polymers or copolymers to form stable bonds. Preferred multifunctional aziridines useful in binding the fireproofing additive of the present invention are N-(aminoethyl)-aziridine, N-aminoethyl-N-aziridyl ethylamine, N,N-bis-2-aminopropyl-N-aziridylethylamine.

The proportion of cross-linking agent to polymer binder depends on the structure of-the cross-linking agent and preferably is in the range of about 0.5% to about 5% by weight of the binder.

The polymer binder and the cross-linking agent are added and mixed into the fireproofing component at the moment of application to the textile material and the product being treated for fireproofing is subjected to heating to dry the product and ensure the cross-linking of the binder. Binder is added to the fireproofing component in quantities ranging from about 1% to about 30% by weight of the fireproofing component.

The fireproofing component and binder of the flame-resistant additive according to the present invention are produced by the SUPER GLANZ company under the commercial names of CABERTEX CLA 200 (fireproofing component) and ACR-EF Stiffener and catalyst (binder).

The flame-resistant additive according to the present invention as previously stated comprises a concentrated aqueous solution having a high specific gravity in the range of about 1.05 to about 1.25, and a viscosity in the range of about 80 to about 300 cps at 23±2° C.

The quantity of flame-resistant additive in accordance with this invention necessary to render the non-woven fabric material fireproof is appreciably less than the quantity of conventional flame-resistant additives necessary to provide the same degree of fireproofing. This quantity is preferably in the range of about 15% to about 60% by weight of the material to be treated, and is more preferably in the range of about 20% to about 40%. It is believed that the high degree of subdivision of the flame-resistant additive according to the invention, in addition to the dispersing and deflocculant action of the adsorbent support, favors the penetration of the fabric by the same, so improving the fireproof characteristics.

In accordance with one preferred embodiment of this invention, the flame-resistant composition is prepared directly at the moment of use or immediately prior to use so as to limit storage problems.

A significant characteristic of the additive in accordance with this invention is that it can be used in large quantities, thereby imparting a high level of flame-resistance to the materials treated, without reducing the aesthetics and softness to the touch of the product.

The fine subdivision of the additive improves the adherence of the same to the material to be treated and that makes possible products that don't show "powdering" phenomena i.e., the separation of the additive.

While the flame-resistant additive in accordance with this invention may be used to impart fireproofing properties to any type of textile material, its use is, however, particularly advantageous in the field of materials constituted by microfiber non-woven fabrics.

The additive in accordance with this invention may be applied to the non-woven fabric material by coating with a knife spreader. However, it has been found that particularly advantageous results can be obtained using a coating treatment (called "transfer roller") in which a roller partially immersed in the suspension of the additive according to this invention, transfers the suspension of the additive from the lower part toward the top onto the "back" face of the material. Regulation of the distance of a shaving roller allows the desired quantity of additive to be carried over onto the transfer roller. The procedure of application of a flame-resistant material to a microfiber non-woven fabric and an apparatus comprising the transfer roller is described in Italian Patent Application M197A001228.

The following examples illustrate the advantages achieved with the application of the fireproofing additive in accordance with this invention on a variety of materials. Such examples are by way of illustration only and should in no way be considered as limiting the scope of this invention.

Resistance to combustion and speed of combustion trials have been carried out on samples of microfiber non-woven fabric and on composite materials—the same materials joined with cotton cloth and polyester cloth, with fireproofed cloths, and with foams.

The additive was applied by dispersing the additive, comprising the fireproofing component and the binder comprising the copolymer and the cross-linking agent, in water. The quantity of additive applied was such as to give the desired quantity of additive (after drying and cross-linking) in the final dry product.

The criteria and methods of evaluation of the trials of the treated materials are indicated below:

Hand:

Evaluated on a scale of 1 to 5, where 5 corresponds to the material having the best softness and 1 corresponds to the material having the worst softness.

Cohesion:

Determined by the UNI 481810 method and providing results inclusive between 5 and 15 Newton.

Fire Resistance:

Determined by the RF1 method which consists of determining the post-combustion time and the post-incandescence time, the damaged zone and the dripping of a test-piece stretched and suspended vertically with a U-shaped support, whose lower free edge was exposed to a flame according to CSE RF 1/751 A standard.

The products evaluated were divided into categories starting from 1A (high resistance to fire).

FMVSS302 (speed of combustion):

It is expressed in millimeters per minute (mm/min.) and was determined with the FMVSS 302 method that consists of determining the speed of combustion, according to the UNI-ISO 3795 standard of a test-piece stretched horizontally on a U-shaped frame, whose free edge is exposed to a flame of modest energy. The speed of propagation was determined both on the material thus treated and on the same material after it had been subjected to dry cleaning and washing with soap and water.

The results of the trials are shown in the following table in which the data obtained are the average of evaluations of different non-woven fabrics materials, either microfiber alone or composite with support, treated with equivalent quantities of flame-resistant additive.

As can be seen from the table, the treatment of the composite material, microfiber, non-woven fabric with the additive in accordance with this invention, beyond influencing in less measure the properties of the product, imparts better flame-resistance for equal quantities of additive applied.

In the table, the products have the followings meanings:

Pannel: Non-woven

Compact: Non-woven fabric composite

Cabertex CLA: 200 Additive comprising melamine, melamine cyanurate, dispersants, wetting agents, suspending media, pH buffers, clay and anti-fermentation agents (SUPER GLANZ product)

ACR EF stiffener Aqueous dispersion of copolymer acrylic styrene (SUPER GLANZ)

Crosslinket: Polyfuctional aziridine (obtainable from SUPER GLANZ)

Coat thickness: Distance in mm between the transfer roller and the coating roller;

Roller tolerance: Distance in mm between the coating roller and the pressure roller Water stain: Stain formation following treatment with water and drying Dispersant dry residue % of product after elimination of water

TABLE

| Trial | No. | 1 | 2 | 3 | 4 | 5 | 6 | 7 | 8 | 9 | 10 | 11 | 12 |
|---|---|---|---|---|---|---|---|---|---|---|---|---|---|
| Cabertex CLA | % | 80 | 80 | 80 | 60 | 60 | 70 | — | — | — | | | |
| Cabertex CLA 200 | % | | | | | | | 80 | 80 | 77 | 67 | 70 | 72 |
| ACR-EF Stiffener | % | | 20 | 20 | 25 | 25 | 30 | 20 | 20 | 23 | 24 | 20 | 18 |
| Water | % | | | | 15 | 15 | | | | | 9 | 10 | 10 |
| Crosslinker | % | | | 2 | 2 | 2 | 2 | | 2 | 1.5 | 1 | 1 | 1 |
| Dispersant dry residue | % | 23 | | | | | | | | | 40 | | |
| Roller separation | mm | | | | | | | | | 0.30 | 0.30 | 0.30 | 0.30 |
| Roller tolerance | mm | | | | | | | | | 0.70 | 0.75 | 0.75 | 0.70 |
| Dry residue per piece | % | — | 23 | 20 | 16 | 15 | 17 | 30 | 35 | 25 | 24 | 23 | 23 |
| FMYSS302/ pannel | Mm damage | | | | 0 ÷ 253 | 253 | 0 ÷ 253 | — | 0 ÷ 115 | 0 ÷ 253 | 0 ÷ 80 | 0 ÷ 65 | 0 ÷ 253 |
| | speed of prop. | | | | 180 | 150 | 170 | — | 95 | 70/ 150 | 30/ 100 | 90 | 30 |
| Hand | — | 2 | 2 | 2 | 2 | 2–3 | 2–3 | — | 3 | 3 | 3 | 3 | 3 |
| Water stain | visible | | | | | | | | no | no | no | no | no |
| Cohesion | Newton | | | | | | | | 5 | 9 | | | 5 |
| FMVSS302/ compact | mm damage | | | | | | | | <253 | | | | <253 |
| | speed of prop. | | | | | | | | <95 | | | | <50 |

| Trial | No. | 13a | 13b | 14a | 14b | 15a | 15b | 15c |
|---|---|---|---|---|---|---|---|---|
| Cabertex CLA 200 | % | 72 | 72 | 72 | 72 | 72 | 72 | 72 |
| ACR-EF Stiffener | % | 18 | 18 | 15 | 15 | 16 | 16 | 16 |
| Water | % | 10 | 10 | 13 | 13 | 12 | 12 | 12 |
| Crosslinker | % | 1 | 1 | 1 | 1 | 1 | 1 | 1 |
| Dispersant dry residue | % | 39 | | 40 | | 41 | | |
| Roller separation | mm | 0.30 | 0.30 | 0.30 | 0.25 | 0.10 | 0.20 | 0.30 |
| Roller tolerance | mm | 0.55 | 0.70 | 0.70 | 0.70 | 0.70 | 0.70 | 0.70 |
| Dry residue per piece | % | 24 | 22 | 32 | 30 | 24 | 25 | 28 |
| FMYSS302/ pannel | Mm damage | 0 ÷ 90 | 0 ÷ 90 | 0 ÷ 253 | 0 ÷ 90 | 0 ÷ 253 | 0 ÷ 253 | 0 ÷ 253 |
| | speed of prop. | 70 | 70 | 35 | 35 | 35 | 35 | 35 |
| FMVSS302 after 3 soap washes | mm damage | | | | | 0 ÷ 70 | 0 ÷ 70 | 0 ÷ 70 |
| | speed of prop. | | | | | 70 | 70 | 70 |
| RF1 | category | 1° ÷ 3° | 1° ÷ 3° | | | 1° ÷ 3° | 1° ÷ 3° | 1° ÷ 3° |
| Hand | — | 3 | 3 | 3 | 3 | 3 | 3 | 3 |
| FMVSS302 after 3 dry cleanings | mm damage | | | | | 0 ÷ 130 | 0 ÷ 130 | 0 ÷ 130 |
| | speed of prop. | | | | | 65 | 65 | 65 |
| Water stain | visible | no | no | no | no | no | no | no |
| Cohesion | Newton | | | | | 9 | 8 | 9 |
| FMVSS302/ compact | mm damage | <253 | <253 | | | <253 | <253 | <253 |
| | speed of prop. | <80 | <70 | | | <55 | <55 | <55 |

What is claimed is:

1. A flame-resistant additive for textile materials and microfiber non-woven fabrics comprising:

a) a fireproofing component comprising a subdivided mixture of melamine and melamine cyanurate and an adsorbent material selected from the group consisting of clay, diatomaceous earth, zeolite, inorganic oxides and mixtures of inorganic oxides; and b) a binder comprising an aqueous dispersion of one of an acrylic polymer or copolymer, or maleic polymer or copolymer, and a multifunctional cross-linker of said one of said acrylic polymer or copolymer, or said maleic polymer or copolymer.

2. A flame-resistant additive for textile materials in accordance with claim 1, wherein said, acrylic copolymer or polymer comprises one of a free carboxyl and an ester group and is selected from the group of polymers and copolymers consisting of acrylic acid, methacrylic acid, esters of acrylic acid, esters of methacrylic acid, salts of acrylic acid, salts of methacrylic acid, and maleic anhydride.

3. A flame-resistant additive for textile materials in accordance with claim 2, wherein the binder comprises a copolymer of styrene and acrylic acid.

4. A flame-resistant additive for textile materials in accordance with claim 1, wherein the cross-linking agent is a multifunctional aziridine derivative.

5. A flame-resistant additive for textile materials in accordance with claim 1, wherein the cross-linking agent is selected from the group consisting of N-(aminoethyl) aziridine, N-aminoethyl-N-aziridyl ethylamine, and N,N-bis-2-aminopropyl-N-aziridylethylamine.

6. A flame-resistant additive for textile materials in accordance with claim 1, wherein the fireproofing component comprises a suspension of particles having an average size less than 10 $\mu$ and in a range of about 0.05% to about 5% by weight of said adsorbent material.

7. A flame-resistant additive for textile materials in accordance with claim 1, wherein said fireproofing component further comprises a material selected from the group consisting of surfactants, dispersants, wetting agents, pH buffers, anti-fermentation agents and mixtures thereof.

8. A flame-resistant additive for textile materials in accordance with claim 1, wherein a ratio of said melamine and said melamine cyanurate in the fireproof component is in a range of about 0.01:1 to about 0.5:1.

9. A flame-resistant additive for textile materials in accordance with claim 1, wherein said melamine and melamine cyanurate in the fireproof component comprise in a range of about 30% to about 90% by weight of said fireproof component.

10. A method for making textile materials fireproof comprising:

treating said textile materials with an additive comprising a fireproofing component comprising a subdivided mixture of melamine and melamine cyanurate and an adsorbent material selected from the group consisting of clay, diatomaceous earth, zeolite, inorganic oxides and mixtures of inorganic oxides, and a binder comprising an aqueous dispersion of one of an acrylic polymer or copolymer, or a maleic polymer or copolymer, and a multifunctional cross-linker of said one of said acrylic polymer or copolymer, or said maleic polymer or copolymer.

11. A flame-resistant additive for textile materials in accordance with claim 3, wherein the cross-linking agent is a multifunctional aziridine derivative.

12. A flame-resistant additive for textile materials in accordance with claim 3, wherein the cross-linking agent is selected from the group consisting of N-(aminoethyl) aziridine, N-aminoethyl-N-aziridyl ethylamine, and N,N-bis-2-aminopropyl-N-aziridylethylamine.

13. A flame-resistant additive for textile materials in accordance with claim 11, wherein the fireproofing component comprises a suspension of particles having an average size less than 10 $\mu$ and in a range of about 0.05% to about 5% by weight of said adsorbent material.

14. A flame-resistant additive for textile materials in accordance with claim 12, wherein the fireproofing component comprises a suspension of particles having an average size less than 10 $\mu$ and in a range of about 0.05% to about 5% by weight of said adsorbent material.

15. A flame-resistant additive for textile materials in accordance with claim 13, wherein said fireproofing component further comprises a material selected from the group consisting of surfactants, dispersants, wetting agents, pH buffers, anti-fermentation agents and mixtures thereof.

16. A flame-resistant additive for textile materials in accordance with claim 14, wherein said fireproofing component further comprises a material selected from the group consisting of surfactants, dispersants, wetting agents, pH buffers, anti-fermentation agents and mixtures thereof.

17. A flame-resistant additive for textile materials in accordance with claim 15, wherein a ratio of said melamine and said melamine cyanurate in the fireproof component is in a range of about 0.01:1 to about 0.5:1.

18. A flame-resistant additive for textile materials in accordance with claim 16, wherein a ratio of said melamine and said melamine cyanurate in the fireproof component is in a range of about 0.01:1 to about 0.5:1.

19. A flame-resistant additive for textile materials in accordance with claim 17, wherein said melamine and melamine cyanurate in the fireproof component comprise in a range of about 30% to about 90% by weight of said fireproof component.

20. A flame-resistant additive for textile materials in accordance with claim 18, wherein said melamine and melamine cyanurate in the fireproof component comprise in a range of about 30% to about 90% by weight of said fireproof component.

* * * * *